United States Patent [19]

Zimmern et al.

[11] Patent Number: 4,579,513

[45] Date of Patent: Apr. 1, 1986

[54] POSITIVE DISPLACEMENT SCREW MACHINE WITH SEPARATION WALL ATTACHED TO SLIDE VALVE

[75] Inventors: Bernard Zimmern, 6 New St., East Norwalk, Conn. 06855; Luc Langouet, Bridgeport, Conn.

[73] Assignee: Bernard Zimmern, East Norwalk, Conn.

[21] Appl. No.: 714,124

[22] Filed: Mar. 20, 1985

[30] Foreign Application Priority Data

Mar. 29, 1984 [FR] France ..... 84 04891

[51] Int. Cl.[4] ..... F01C 3/02; F01C 1/16

[52] U.S. Cl. ..... 418/159; 418/195; 418/201

[58] Field of Search ..... 418/159, 195, 201-203; 417/310, 440; 251/326-329; 137/625.25

[56] References Cited

U.S. PATENT DOCUMENTS

| | | | |
|---|---|---|---|
| 3,013,770 | 12/1961 | Anderson | 251/329 |
| 3,088,659 | 5/1963 | Nilsson et al. | 418/159 |
| 3,151,806 | 10/1964 | Whitfield | 418/159 |
| 3,314,597 | 4/1967 | Schibbye | 418/159 |
| 3,904,322 | 9/1975 | Axelsson | 417/310 |
| 4,005,949 | 2/1977 | Grant | 418/201 |
| 4,234,296 | 11/1980 | Matsubara | 418/201 |
| 4,455,131 | 6/1984 | Werner-Larsen | 418/201 |

FOREIGN PATENT DOCUMENTS

| | | |
|---|---|---|
| 218309 | 4/1961 | Austria . |
| 3143193 | 8/1982 | Fed. Rep. of Germany . |
| 782350 | 3/1935 | France . |
| 1182571 | 1/1959 | France . |
| 1258650 | 3/1961 | France . |
| 2321613 | 3/1977 | France . |
| 384355 | 12/1932 | United Kingdom . |
| 2051244 | 1/1981 | United Kingdom . |

*Primary Examiner*—Leonard E. Smith
*Assistant Examiner*—Jane E. Obee
*Attorney, Agent, or Firm*—Ziems, Walter & Shannon

[57] ABSTRACT

In a screw volumetric machine, a slide is slidable in a groove along a bore accommodating the screw. This slide is movable to vary the delivery and/or compression ratio. One end of the groove communicates with the low pressure. The other end of the groove communicates with the high pressure. A separation wall separates the two pressures behind the slide. The slide is leak-tightly urged against a free end of the separation wall by holding means which slidingly retain the slide in the groove.

6 Claims, 20 Drawing Figures

Fig. 1
PRIOR ART
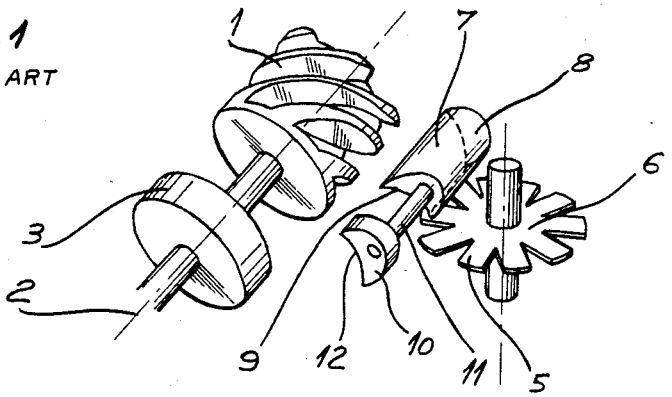
Fig. 2
PRIOR ART
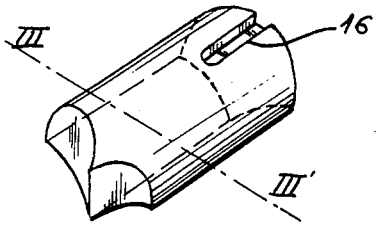
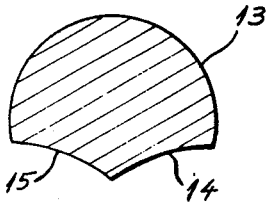
Fig. 3
PRIOR ART
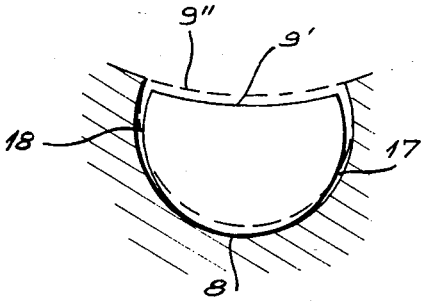
Fig. 4
PRIOR ART

POSITIVE DISPLACEMENT SCREW MACHINE WITH SEPARATION WALL ATTACHED TO SLIDE VALVE

French Pat. No. 2.321.613 as to single screw compressors or expansion machines, and U.S. Pat. No. 3,088,659 as to twin screw compressors or expansion machines, disclose how to control the capacity and/or the compression ratio by moving slides mounted in grooves, having generally a cylindrical shape with a partly circular cross-section and generating lines extending parallel to the axis of the screw(s).

Hereinbelow, the invention will be described while taking the example of compressors, but the invention also applies to expansion machines, by changing the direction of rotation of the screw(s).

Such a known device, as shown in the exploded view of FIG. 1, comprises a screw 1 of a single screw compressor rotating about an axis 2 in a bearing holder 3 within a casing not shown here, threads of the screw meshing with teeth 5 of a pinion wheel 6 rotatably mounted in said casing. A part-cylindrical groove, the axis of which is parallel to axis 2, is provided in the casing, and movably accomodates a slide 7 having a rear face 8 matching the shape of the groove, and a front face 9 which is in substantially leak-tight contact with the thread crests of the screw, which crests belong to a common ideal cylinder.

As is known, axial displacement of the slide results in varying the capacity and/or the compression ratio of the machine.

In order to prevent the slide 7 from rotating in the groove, the above mentioned patent discloses connecting the slide to a shoe 10 via a connecting leg 11, the shoe having a face 12 engaging the cylindrical bearing holder 13.

Similarly FIG. 2 is a perspective view of a known slide appropriate for a twin screw compressor. FIG. 3 is a sectional view of such a slide along III—III' of FIG. 2.

This slide also has a cylindrical shape, and its cross-section is comprised between a circular arc 13 extending over more than 180 degrees, this arc being in contact with the groove provided in the casing, and two circular arcs 14 and 15 adapted to be in leak-tight contact with the thread crests of the screws. A key, not shown, mounted in the casing, fits into a keyway 16 and prevents the slide from rotating.

These devices, though commonly used, have numerous drawbacks.

Firstly, a minimum play is necessary between the slide and the groove, and between the slide and the screw for allowing introduction of the slide during assembly of the machine. Owing to the manufacturing tolerances, this results in the slide having in its groove a play that may be substantial.

Considering the example of a single screw compressor with a screw having a diameter of 140 mm, the diameter of the slide as shown in FIG. 1 is about 50 mm, even with the rather high manufacturing precision of class 7, standard tolerances h7/H7 result in extreme cases to diameter differences of 50 microns between the slide and its groove. Since the casing surrounds the slide along only 220 degrees approximately, the slide can move radially by approximately 75 microns. This is shown in FIG. 4, which is a sectional view of the slide of FIG. 1, in solid lines when engaging on region of the groove, and in dotted lines when engaging the opposite region of the groove. This results in the need of recessing face 9 so that, even in its position 9'', the slide does not contact the screw; thus, when the slide is in its position 9', there is between the slide and the screw, a substantial play which results in leaks corresponding to an efficiency lost of several percent.

Moreover, FIG. 4 shows that there are passages 17, 18 with an arcuated cross-section between the slide and its groove; these passages also allow leaks and are thus also detrimental to the efficiency.

Such drawbacks are furthermore amplified because the plays in question entail, in turn, an inaccurate angular positioning of the slide which, in the embodiment of FIG. 2 for instance, can oscillate about its key, so that safety plays yet larger than those shown in FIG. 4 are necessary.

For reasons similar to those set forth as to slide 7, the face 12 of shoe 10 of FIG. 1 need some play with respect to the bearing holder 3 and this leads to increase recessing of face 9 so as to avoid that the slide could contact the screw when pivoting.

These effects may be reduced by maximizing the wrapping angle of the groove around the slide, in other words, for a given passage section of the slide in the casing—proportional to the width of face 9, which in turn is a consequence of conditions of flow speeds and pressure losses—by maximizing the diameter of the groove and of the corresponding cross-section of the slide.

This not only results in an important increase on the space requirement but also in very high axial thrusts acting on the slide (because, as is known, one extremity of the slide is subjected to the high pressure, the other to the low pressure) which must generally be compensated by increasing the size of the slide actuating pistons.

An object of this invention is a positive displacement screw machine such as a compressor or an expansion machine, comprising at least one screw provided with thread grooves and thread crests, and rotatably mounted in a rotatable element meshing with the screw in order to define in the threads grooves variable volume chambers, at least one low pressure plenum and at least one high pressure plenum being arranged in the casing along the bore, wherein a stationary separation wall separates in said groove the high and low pressure plenums, a space being provided between a free end of said wall and the screw, wherein a slide is mounted in said space in substantially leak-tight contact, at least during part of its travel, on a one side with said free end, on another side with the screw, and wherein means are provided for retaining the slide against the separation wall.

This device has a number of remarkable results:

it practically cancels any radial and angular play without requiring tighter machining tolerances; thus the surface of the slide which co-operates with the screw(s) may be on the same cylinder as the bore of the casing in which the screw(s) rotate(s). Accordingly, said face of the slide can be machined in situ at the same time as the bore(s) of the casing;

almost any play between the slide and its groove is cancelled, which reduces the leaks.

Both these results considerably improve the efficiency, especially considering a single screw compressor with a screw having a diameter of 140 mm rotating at 3000 rpm and compressing Refrigerant 22 without oil injection, the increase in isentropic efficiency may exceed 10% at the higher pressure ratios usual in heat pumps.

But the invention furthermore allows to reduce the cross-sectional area of the slide and thus the axial thrust prevailing on the slide, and consequently the size of the pistons or other actuating devices of the slide.

Moreover, especially because the frictional surfaces are reduced in area, and also because they can be prepared outside the casing and thus may be easily provided with excellent surface conditions, the slide is able to operate under very small pressure differences. This is of interest in heat pumps for significantly reducing the duration of the defrosting operation, as will be explained in further detail in the description.

Finally, indexing and holding means such as the shoe 10 on FIG. 1 are no longer necessary. Thus, on either side of the slide, the groove has free portions able to accomodate, if needed, auxiliary slide elements allowing, notably, to vary independently the capacity and the compression ratio.

This invention will be more readily understood by the description hereinbelow and the attached drawing, given as non-limitating examples in which.

Figure 5:
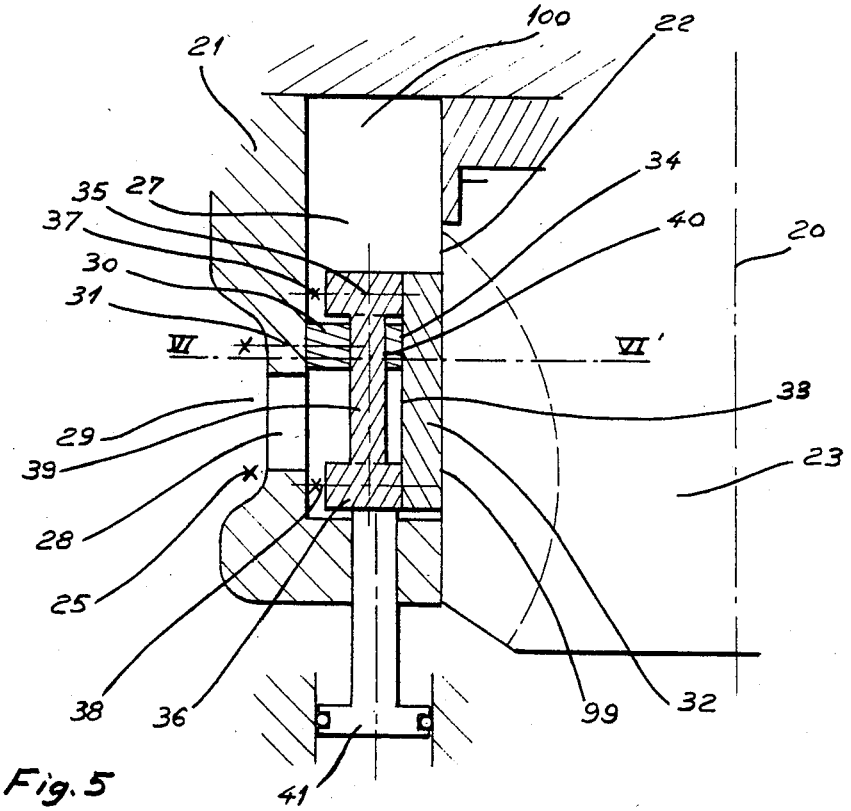
FIG. 5 is a sectional view, along an axial plane of a single screw compressor, of a slide according to the invention.
Figure 6:
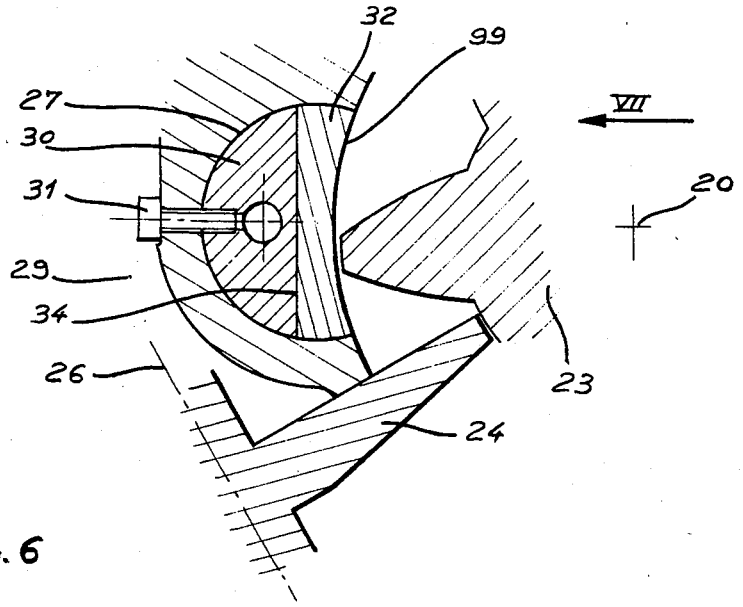
FIG. 6 is a section along VI—VI' of FIG. 5.

FIG. 5 is a sectional part view along the axis 20 of a single screw compressor; in the casing 21 there is a bore 22 in which a globoid screw 23 having several threads rotates around an axis 20, the threads of said screw meshing in a known way with at least one pinion wheel 24, partly shown in section in FIG. 6. Said pinion rotates about an axis 25, (FIG. 5,) the projection of which upon the plane of FIG. 6 is shown in 26.

Within the casing 21, there is provided a groove 27 having the shape of a cylinder with a part-circular cross-section (FIG. 6). This groove communicates on one side via a passageway 28 with the plenum 29 surrounding the axis of the pinion wheel, said plenum being in turn connected to the low pressure, on the other side via a passageway in the casing, not shown but known per se, with the high pressure prevailing in the plenum 100. In the groove, a separation wall 30 is secured to the casing by a holding screw 31. This separation wall separates the high pressure prevailing in the section 100 of the groove from the low pressure prevailing on the other side.

As, for the reasons already set forth with respect to the play of the slide, it is impossible to manufacture a wall 30 matching exactly the diameter of the groove 27, it is useful to insert at the time of assembly a glue, such as the one sold under the LOCTITE brand name, between the surfaces of the wall 30 and the casing in contact, so as to ensure complete leak-tightness around the circular periphery of the separation wall 30.

Figure 7:
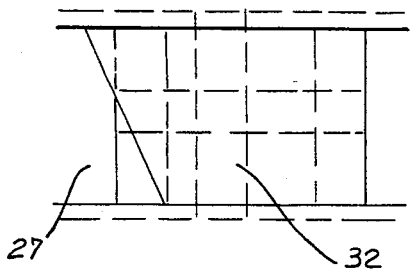
FIG. 7 is a part view, from inside the casing along the arrow VII of FIG. 6, after removal of the screw.

As shown in FIGS. 5 and 6, a section along VI—VI' of FIGS. 5 and 7 (a view from inside the casing along the arrow VII of FIG. 6), the slide 32 itself, has, as seen from inside the casing (FIG. 7), a shape already known, especially through French Pat. No. 2.321.613.

The slide 32 has a rear face 33 engaging a free end 34 of the separation wall 30.

Furthermore, slide 32 is urged against said separation wall by compensating—or holding means comprising in the example of FIG. 5 two legs 35 and 36, secured to the slide by screws 37 and 38, and integral with a rod 39 slidably mounted in a through hole 39 of the separation wall 30.

A piston 41 mounted in the casing allows to move the slide.

It should be noted that the plays, thus the leaks, compared to FIGS. 1 and 4, have been significantly reduced. The only remaining play is in fact the lateral play between the slide 32 and the groove 27, which is obviously only a small fraction of the plays 17 and 18 of FIG. 4. To be quite complete, the play between the holding means form a sub-assembly which can be assembled outside the compressor with all the accuracy needed before being mounted inside the groove 27 by way of the screw 31.

It should also be noted that, thanks to this device, the slide 32 can neither rotate, nor move toward the casing. It it thus possible to perform final machining of the front surface 99 of the slide, which must have a substantially leak-tight contact with the screw, at the same time as the bore 22 of the casing.

Owing to this, it is possible to set the play between the face 99 of the slide and the screw equal to that between the casing and the screw, i.e. in the case for instance of a screw diameter of 140 mm, an operating play not exceeding some 30 microns, that is to say at least 2 or 3 times smaller than the play needed by the embodiments of FIGS. 1 to 4.

The axial thrust prevailing on the slide is proportional to the pressure differential between high and low pressures and proportional to the cross sectional area of the movable member i.e. the area comprised between the faces 33 and 99, plus the section of the axis 39.

Said sectional area being much smaller than the sectional area of the groove 27, and the latter being equal to the sectional area of a slide according to FIG. 1, there results a reduction of the axial thrust acting on the slide in proportion to that of the sectional areas; owing thereto it is possible to significantly reduce the cross-section of the slide actuating piston 41.

Because the frictioning areas have been reduced as well as because the frictioning parts can be machined and assembled outside the compressor, and by simple milling excellent surface conditions and better friction coefficients can be achieved, there also results that the effort to overcome these frictions is smaller than in the prior art.

This leads to an important result in heat pumps by reducing the duration of the defrost1ng cycles. As is known, a heat pump is generally defrosted by mutually inverting the actions of the evaporator and of the condenser. At the time of change-over, this results in a balance of upstream and downstream pressures; however, the pressure differential is usually used to actuate the slides and to bring them, after exchange of evaporator and condenser, from compressor part-load to compressor full-load positions, the latter being of course the one where the production of defrosting heat is maximum.

Thus, the greater the resistance to be overcome to move the slide from part-load to full-load position, the longer the compressor operates at part load, which practically extends by the same amount the duration of the defrosting operation, during which the heat pump is unavailable.

According to the invention, the means for holding and angularly locking the slide are accomodated in the space left free by the reduction in thickness of the slide, between the slide and the bottom of the groove. Accordingly, extensions such as shoe 10 of FIG. 1 are no longer necessary and this side of the slide remains free, allowing to implement, as will be seen hereafter, other independent movable parts allowing to achieve new functions.

The invention does not need that the separation wall 30 be removable and that the shape of the groove 27 be cylindrical and circular.

Figure 8:
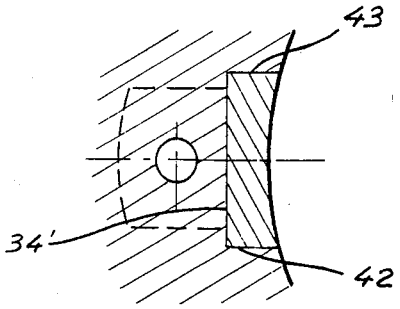
FIG. 8 shows an alternative embodiment of FIG. 6.

The separation wall could be made integral with the groove 27 directly by molding. It would then be enough to machine, as shown in FIG. 8, the free end face 34' of the separation wall and the side walls 42 and 43 of the slide passage. It would even not be necessary that face 34' be flat, other shapes being possible if face 33 of the slide is correspondingly profiled.

Other embodiments of the same invention have been shown on FIGS. 9 to 13, differing from the embodiment of FIGS. 5 and 6 in that the holding means of the slide do not pass through the separation wall, thus eliminating the need for an accurate fit of the rod 39 and the hole 40, or the possibility of leaks in case of a poor fit.

Figure 9:
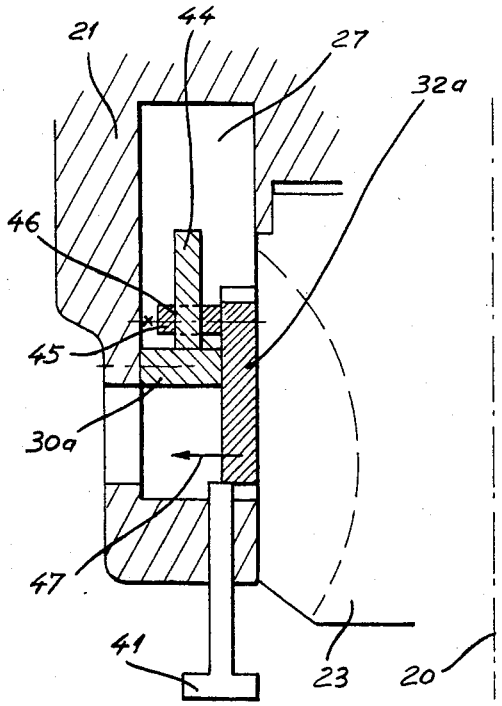
FIGS. 9, 10 and 12 are sectional views, along an axial plane of the screw, of three other embodiments of the invention.

In FIG. 9, the separation wall 30*a* is integral with a rod 44 on which a bracket 45, provided with a bore and integral with the slide 32*a*, is slidingly mounted.

The pressure of the compressed gas generally generates a thrust in the direction of the arrow 47 and it is thus only necessary to provide holding means on the high pressure side where, to the contrary, the resultant of the thrusts may tend to lift the slide away from the separation wall.

It is nevertheless convenient to replace the rod 44 by a rail 48 (FIGS. 10 and 11) which is flush with the face 34*b* of the slide. The slide 32*b* is movable along the rail 48. Said slide is maintained against the rail by a clamp 50 which slides along that side of the rail, which faces away from the slide. Then, extending rail 48 in a rail 49 toward the low pressure and pulling back the slide by another clamp 51 is not expensive. Since the face 34*b* of the rail has been machined, say milled, it is easy to mill the opposite face of the rail.

Figure 10:
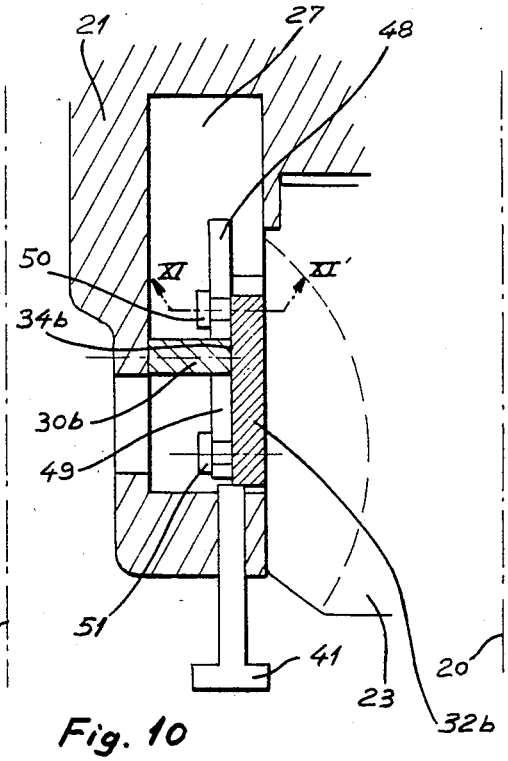
Figure 11:
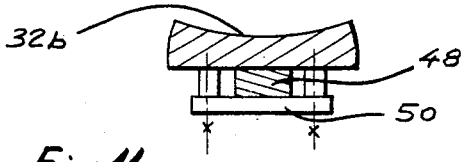
FIG. 11 is a sectional view along line XI—XI' of FIG. 10.
Figure 12:
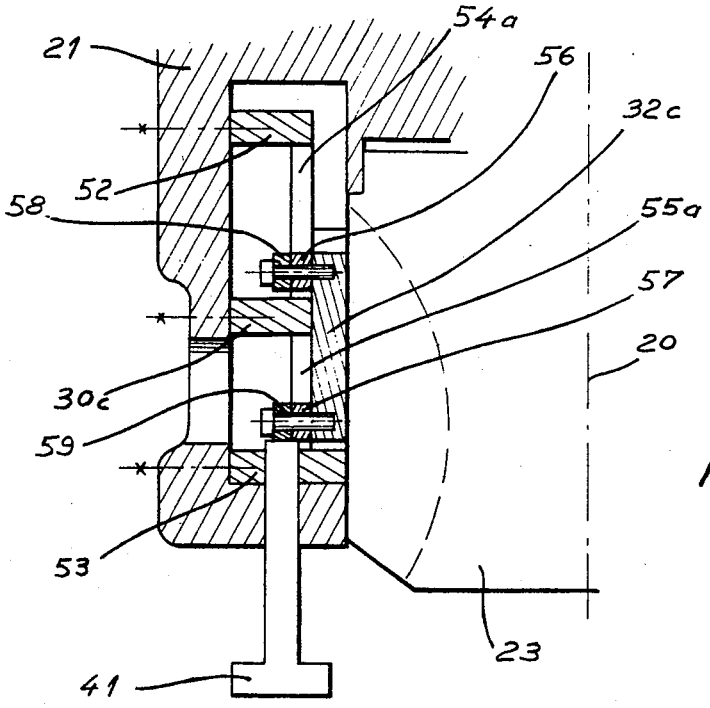
Figure 13:
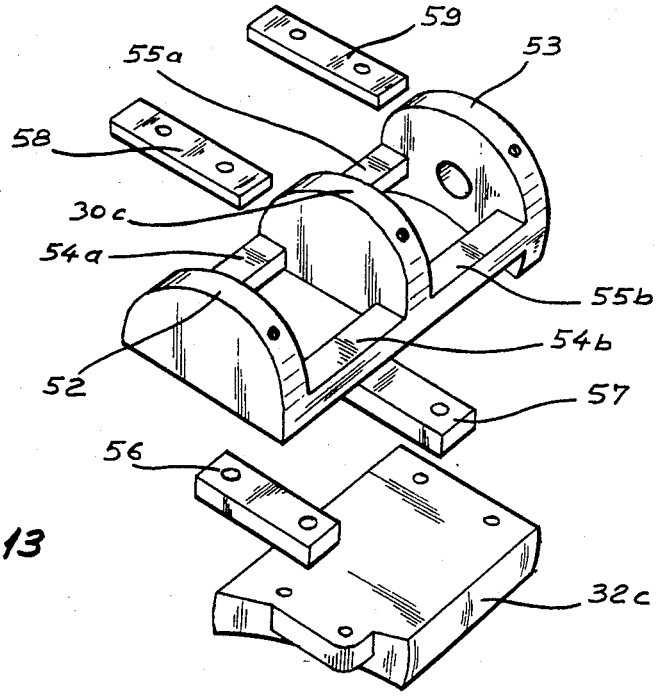
FIG. 13 is an exploded perspective view of the embodiment of FIG. 12.

A similar arrangement is shown in FIGS. 12 and 13, which differ from FIG. 10 by an increased rigidity. This increase in rigidity is obtained by securing the ends of the rails to the casing by means of end flanges 52 and 53, which have been shown in the example as having the same shape as the separation wall 30*c* but which perform no sealing function between the high and the low pressure and could therefore reduced to simple posts.

The rigidity is furthermore obtained by providing on either side of the separation not one but two rails 54*a*, 54*b*; 55*a*, 55*b*.

The spacers 56 and 57, which define the location of the clamps 58 and 59 can be milled together with the rails 54 and 55, so as to provide them exactly the same thickness.

Then, during assembly, a drop of a liquid such as the commercial brand LOCTITE is placed between the spacers and the clamps so as to generate very easily and cheaply a play of some microns between the clamp and the rail, providing the sliding movement of the assembly with a radial play reduced practically to zero with respect to the screw.

Figure 14:
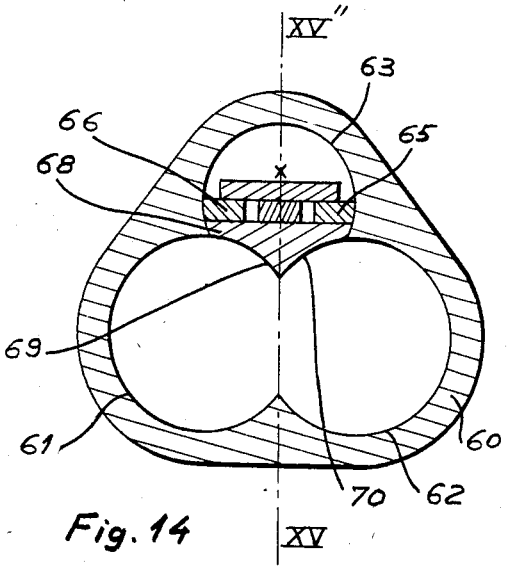
FIG. 14 is a sectional view, along plane XIV—XIV' of FIG. 15, perpendicular to the axis of the screws, of an arrangement according to the invention, in a twin screw compressor.
Figure 15:
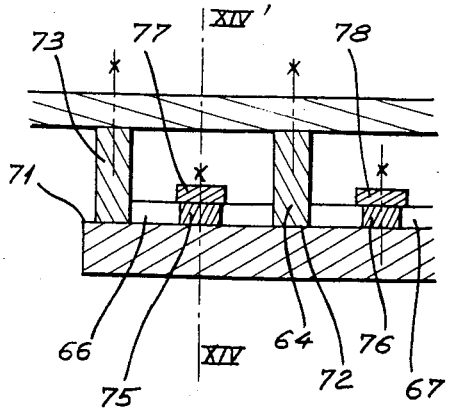
FIG. 15 is a sectional part view of the slide and its support, along XV—XV' of FIG. 14.

FIG. 14 is a sectional view along XIV—XIV' of FIG. 15, of the casing of a twin-screw compressor provided with a slide according to the invention.

A screw is rotatably mounted in a bore 61 of a casing 60. The threads of said screw mesh with the threads of a second screw rotatably mounted in a second bore 62.

A third bore 63 forms a groove in which a separation wall 64 is secured. The separation wall 64 is integral with two pairs of rails provided on either side of the separation wall, such as 65 and 66 (FIG. 14) or 67 (FIG. 15).

The slide 68 has two faces 69 and 70 of partcircular section, which are adjacent the screws and in leak tight contact with the thread-crests of the screws, and a face 71 in contact with the free end face 72 of the separation 64.

In order to increase the rigidity it may be of interest to secure the distal end of the rails, such as 65 and 66, to the casing through a flange such as 73.

Spacers such as 75 and 76 and clamps 77 and 78 act as holding means of the slide and ensure, as in the case of FIG. 13, that the play of the slide on its rail is practically zero.

Figure 16:
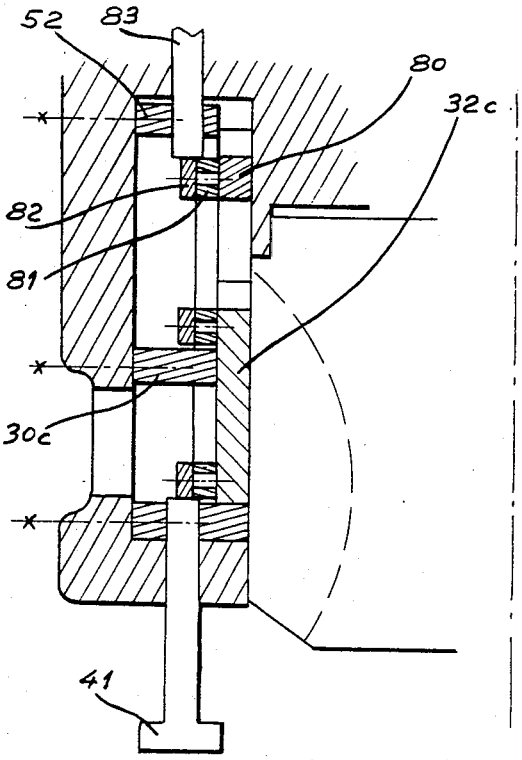
FIG. 16 is a sectional view along an axial plane of a single screw compressor, of an embodiment alternative to that of FIG. 12, incorporating an auxiliary slide.

FIG. 16 shows an alternative implementation to that of FIGS. 12 and 13. The space kept free in the groove allows mounting on the same rails a second auxiliary slide 80 held against the rails by the same arrangement as for the main slide 32*c*, i.e. spacers such as 81 and clamps such as 82.

Figure 17:
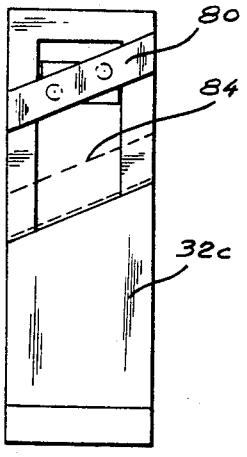
FIG. 17 shows from inside the casing, the slide and the auxiliary slide of FIG. 16.

This slide can be either in the position shown on FIG. 17 in solid lines, or be moved by an actuating piston 83 to the position shown in dotted lines in 84.

In that position, this auxiliary slide operates as an extension of the slide 32*c*, whereby, as is known per se, the compression ratio is increased.

It is thus possible to vary the delivery by moving the slide 32*c* and moreover for any position of the slide 32*c*, to choose between two compression ratios available according to the auxiliary slide 80 being or not in contact with the main slide, which practically, notably in refrigeration or air conditioning applications, permits to come within less than 1% of the optimum thermodynamic efficiency. The auxiliary slide 80 has a profile, transverse to the axis of the groove, generally parallel to the high pressure extremity of the slide 32*c*.

According to the invention, the holding means are not necessarily integral with the separation wall and there is no need of maintaining the slide in contact with the free end of the separation over the whole distance of its travel.

Figure 18:
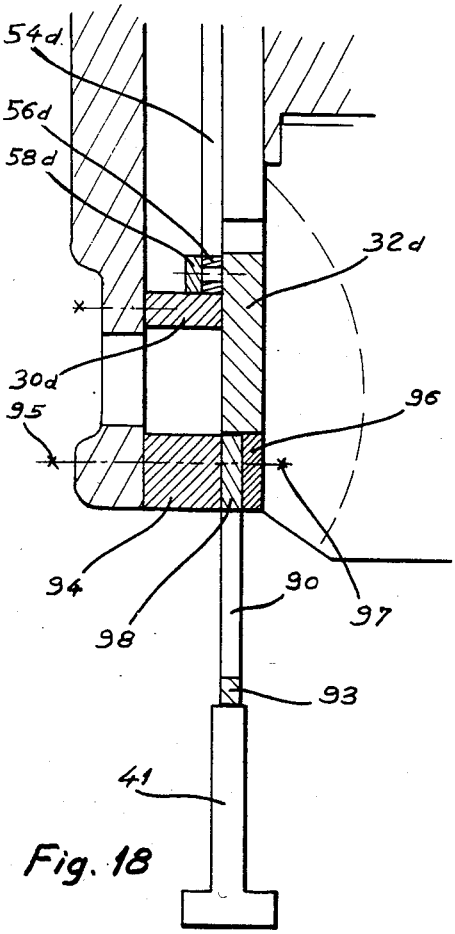
FIG. 18 shows another alternative embodiment to that of FIG. 12, with a different arrangement of the holding means.

In the embodiment of FIG. 18, a slide 32*d* is held, as in the embodiment of FIG. 12, against a rail 54*d* located on the high pressure side, by a c1amp 58*d* fastened—by screws not shown here—on the slide 32*d* through a spacer 56*d*.

But on the low pressure side, the slide is extended into a stretcher 90 made of two legs 91 and 92 connected by a cross-beam 93. This stretcher is maintained against a brace 94 (which may have the same shape as the separation 30*d*) secured to the casing by means of a fastening screw 95, by means of a fixed clamp 96 maintained by the screw 97 against a spacer 98 mounted between the two legs 91 and 92 of the stretcher 90.

The clamp 96 has adjacent the screw a face which is flush with the bore of the casing, and may be machined at the same time.

Figure 19:
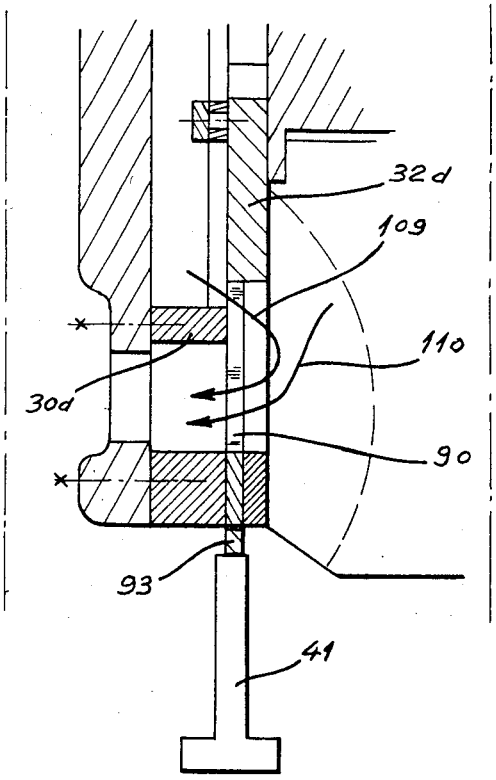
FIG. 19 shows the implementation of FIG. 18 when the slide is in an end position allowing zero capacity.
Figure 20:
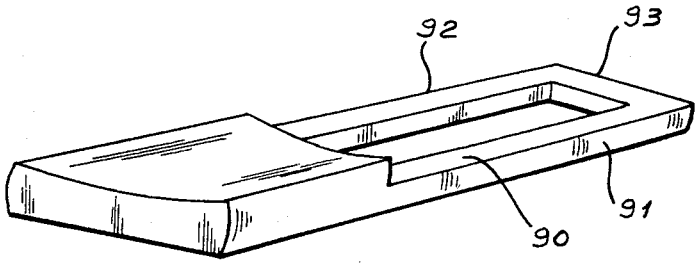
FIG. 20 is a perspective view of the slides of FIGS. 18 and 19.

FIG. 19 shows the arrangement of the slide 32*d* when it is fully pushed down by the piston 41. In this position the slide 32*d* is not any more in contact with the separation 30*d*. This leads to the high pressure section of the groove 27 as well as the high pressure end of the threads of the screw communicating with the low pressure by the pathes along the arrows 109 and 110; in this position, the compression is completely cancelled, as is known per se through U.S. Pat. No. 4,261,691.

The slides have been shown as actuated by pistons, but any other actuating means, such for example as an electric motor driving a ratch could have been used without changing the invention.

The invention has been shown with a single slide per compressor, but without changing the invention it would be possible, especially in the case of the single screw compressor, to use two or more pinion wheels, meshing with the same screw, and a corresponding number of slides and grooves.

We claim:

1. A positive displacement screw machine such as a compressor or an expansion machine, comprising at least one screw (23) provided with thread grooves and threads crest and rotatably mounted in a bore of a casing (21), at least one rotatable element meshing with the screw in order to define in the thread grooves variable volume chambers, at least one low pressure plenum and at least one high pressure plenum being arranged in the casing on either end of the screw, at least one groove (27) communicating with the high pressure plenum and with the low pressure plenum being arranged in the casing along the bore, wherein a stationary separation wall (30) separates in said groove the high and low pressure plenums, a space being provided between a free end of said wall and the screw, wherein a slide (32) is slidably mounted in said space in substantially leak-tight contact, at least during part of its travel, on a one side with said free end, on another side with the screw, and wherein means are provided for retaining the slide against the separation wall.

2. A machine according to claim 1 wherein said slide retaining means comprise a cylinder (39) slidably mounted in a through hole (40) provided in said separation wall and connecting means to connect said cylinder and said slide on either side of the separation wall.

3. A machine according to claim 1 wherein said slide retaining means comprise at least one rail (44), stationary with respect to the separation wall and connecting means for connecting the rail and the slide.

4. A machine according to claim 3, wherein the rail has a one surface which is directed towards the slide and includes a surface of the free end of the separation wall in substantially leak-tight contact with the slide.

5. A machine according to claim 4 wherein the rail has a second surface parallel to and facing away from said one surface of the rail, and wherein said connecting means comprise at least one spacer (56, 57) having a thickness equal to that of the rail and at least one clamp (58, 59) tightly mounted on the spacer and in contact with said second face.

6. A machine according to claim 4 wherein an auxiliary slide is mounted on the rail on the high pressure side of the slide, said auxiliary slide having adjacent the screw bore and transverse to the groove a profile generally parallel to an high pressure end of the slide.

* * * * *